US007036165B2

(12) United States Patent
Weinman et al.

(10) Patent No.: US 7,036,165 B2
(45) Date of Patent: May 2, 2006

(54) ADJUSTABLE BED WITH AUTOMATIC ADJUSTING HEAD SECTION

(75) Inventors: Adam Michael Weinman, Tampa, FL (US); German Borda, Brandon, FL (US)

(73) Assignee: L&P Property Management Company, Cincinnati, OH (US)

( * ) Notice: Subject to any disclaimer, the term of this patent is extended or adjusted under 35 U.S.C. 154(b) by 0 days.

(21) Appl. No.: 10/404,044

(22) Filed: Apr. 2, 2003

(65) Prior Publication Data

US 2004/0194213 A1 Oct. 7, 2004

(51) Int. Cl.
*A61G 7/00* (2006.01)

(52) U.S. Cl. ..... 5/617; 5/618

(58) Field of Classification Search ..... 5/617, 5/618

See application file for complete search history.

(56) References Cited

U.S. PATENT DOCUMENTS 1,281,074 A * 10/1918 Russell ..... 5/634
3,051,965 A * 9/1962 Szemplak et al. ..... 5/616
3,281,141 A * 10/1966 Smiley et al. ..... 5/614
3,635,461 A * 1/1972 Bellucci et al. ..... 5/616
3,754,749 A * 8/1973 Lyon et al. ..... 5/618
4,103,170 A * 7/1978 Spradlin ..... 378/179
4,258,445 A * 3/1981 Zur ..... 5/614
4,349,924 A * 9/1982 Zur ..... 5/618
4,381,571 A 5/1983 Elliott
4,385,410 A 5/1983 Elliott et al.
4,407,030 A 10/1983 Elliott
5,497,518 A * 3/1996 Iura ..... 5/618
5,537,701 A 7/1996 Elliott
5,640,730 A * 6/1997 Godette ..... 5/618
5,870,784 A 2/1999 Elliott
6,276,011 B1 8/2001 Antinori
2002/0066142 A1* 6/2002 Osborne et al. ..... 5/600

* cited by examiner

*Primary Examiner*—Sunil Singh
(74) *Attorney, Agent, or Firm*—Diller, Ramik & Wight

(57) ABSTRACT

An adjustable bed includes at a minimum a head support and a back support pivotally connected to each other, a mechanism for pivoting the head support automatically from a first position horizontal and coplanar to the back support to an inclined position, and the latter mechanism being effective upon further operation to pivotally move the back support from its horizontal position to any one of a number of inclined positions without altering the inclination of the head support relative to the back support.

15 Claims, 6 Drawing Sheets

ADJUSTABLE BED WITH AUTOMATIC ADJUSTING HEAD SECTION

BACKGROUND OF THE INVENTION

The invention is directed to an adjustable bed of the type that includes a plurality of relatively pivoted and adjustable supports, such as leg, thigh, hip and back supports, but in addition thereto a head support is pivotally attached to the back support and is automatically inclined relative thereto when the back support is moved from a planar horizontal position to an inclined position.

Typical of the adjustable or articulated beds of the type to which the present invention is directed are disclosed in U.S. Pat. Nos. 4,381,571; 4,385,410; 4,407,030; 5,537,701; 5,870,784 and 6,276,011 B1. All such adjustable beds include a number of common support structures, drive mechanisms and functions, such as pivots, brackets, linkages, lost motion connections, drive motors, etc. for achieving relative adjustment of the bed sections between numerous positions of adjustment. However, no adjustable beds are provided with simple, inexpensive and substantially foolproof mechanisms for tilting, inclining or adjusting a head support relative to a back support of an associated adjustable bed.

SUMMARY OF THE INVENTION

In keeping with the foregoing, a primary object of the invention is to provide an adjustable bed which includes a frame preferably carrying one mechanism for selectively relatively adjusting thigh and leg supports and another mechanism for relatively adjusting a back support and automatically therewith adjusting a head support relative to the back support. The back support is pivotally connected to both a thigh support and a head support, and a pivoting mechanism is operative through linkages for pivoting the back support and the head support from a first coplanar horizontal position to a second position at which the back support remains horizontal but the head support is tilted or inclined upwardly and forwardly. The latter position allows a person to lie in the bed substantially prone or horizontal upon all body supports, except the head support. This position is highly desirable for a number of purposes, such as viewing television while lying prone and, from a medical standpoint, effecting nasal drainage and maintaining airways open, particularly with respect to persons suffering from sleep apnea. The back support can be further selectively moved from a horizontal position to a variety of different inclined positions at any one of which the inclined angle between the head support and the back support remains the same.

The mechanism for effecting the adjustment, tilting or inclination of the head support relative to the back support is a motion transmission mechanism operative in response to a back support pivoting mechanism which includes cooperative cam and cam follower means. When both the head support and the back support are in a common horizontal plane, initial movement of the cam acts upon the cam follower to tilt the head support forwardly and upwardly while the back support remains motionless and horizontal. Thereafter, the cam and cam follower remain relatively motionless as the back support is pivoted from its horizontal position to any one of several inclined positions of adjustment.

The motion transmission mechanism preferably includes two linkages. A first linkage is pivotally connected to the back support and carries the cam while the cam follower is connected to the head support. A second linkage is pivotally connected to the frame and operates through an arm of the first linkage to pivot the first linkage and move the cam relative to the cam follower to effect movement of the head support relative to the back support.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENT

Figure 1:
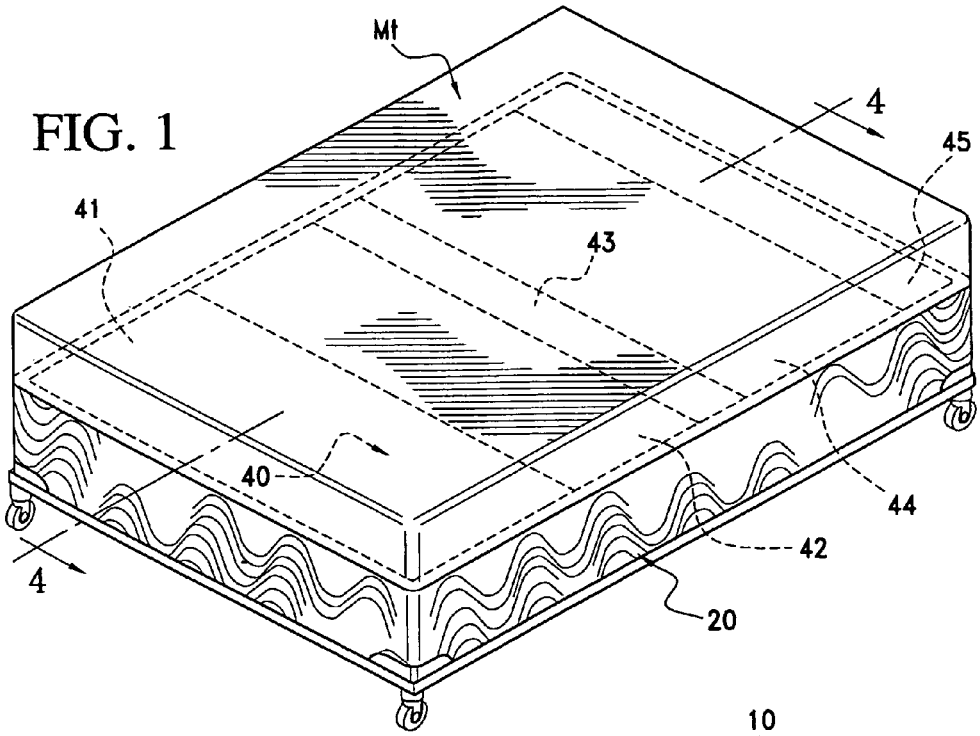
FIG. 1 is a top perspective view of a novel adjustable bed constructed in accordance with this invention, and illustrates a mattress supported atop a main frame which simulates a box spring.
Figure 2:
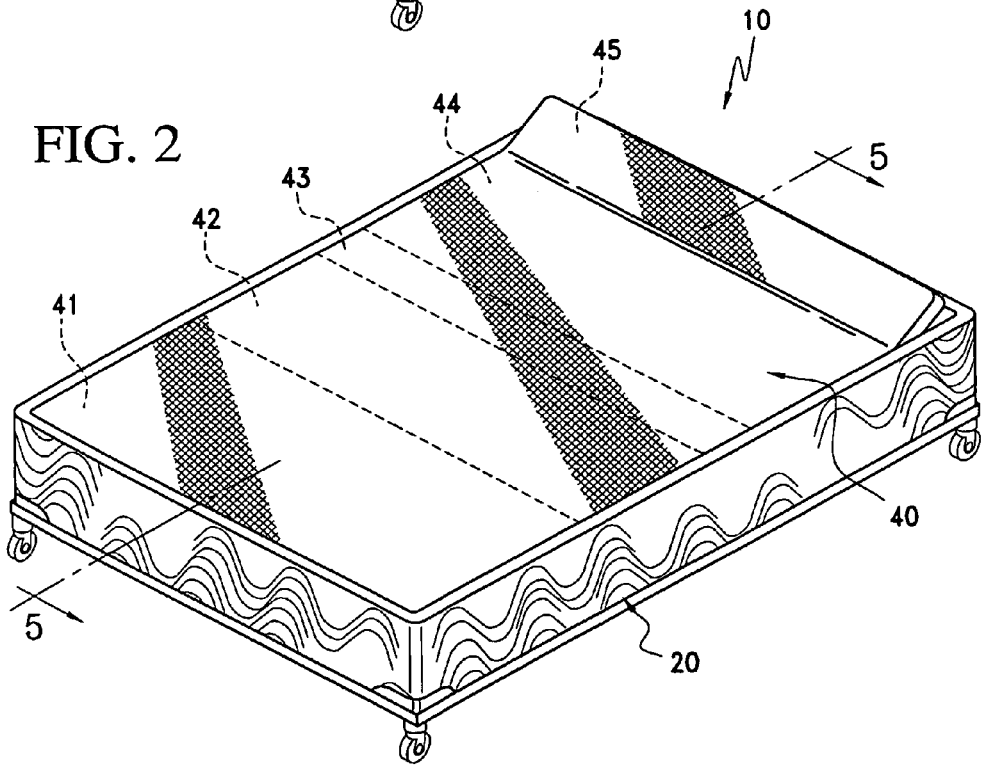
FIG. 2 is a perspective view of the adjustable bed of FIG. 1 with the mattress removed, and illustrates a head support tilted relative to remaining body supports which lie in a common horizontal plane.
Figure 3:
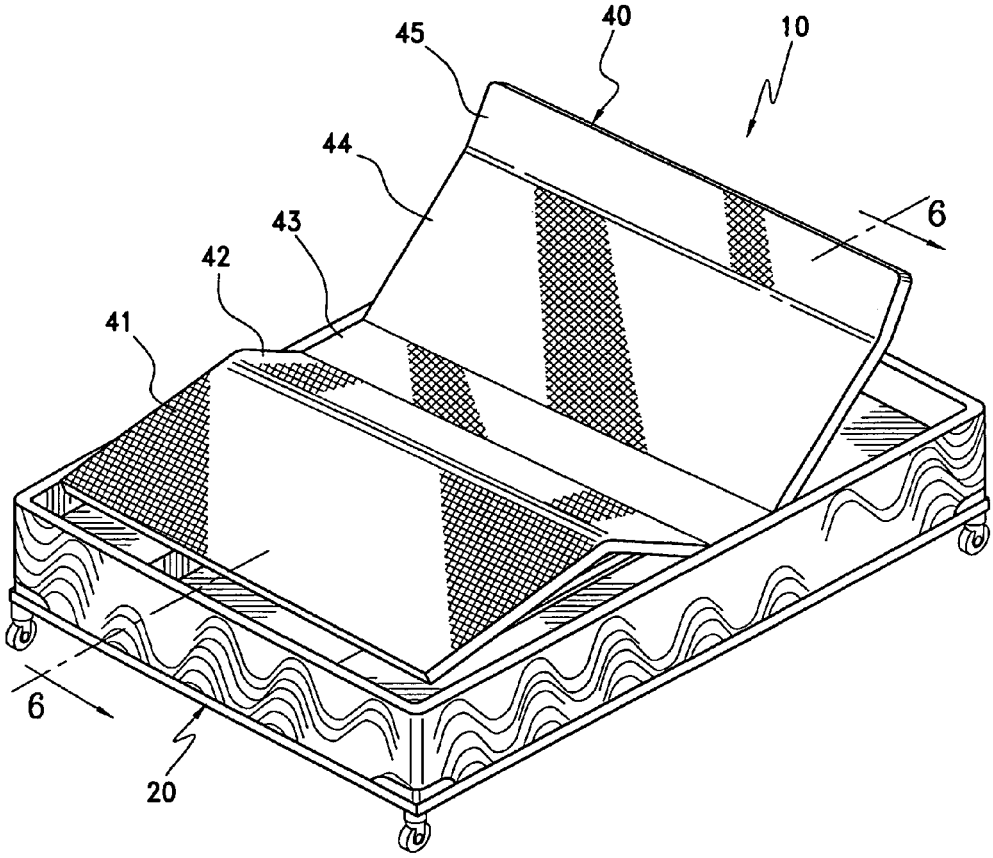
FIG. 3 is a perspective view of the adjustable bed of FIGS. 1 and 2, and illustrates the back support inclined to the horizontal without a change in the inclination of the head support relative thereto as compared to the positions illustrated in FIG. 2.

A novel adjustable or articulated bed is illustrated in FIGS. 1 through 7 of the drawings and is generally designated by the reference numeral 10.

The adjustable bed 10 includes a bed frame 20 which is constructed in accordance with the disclosure of U.S. patent application Ser. No. 10/226,337 filed on Aug. 23, 2002 entitled "A Universal Adjustable Bed" which is incorporated entirely hereat by reference.

Figure 6:
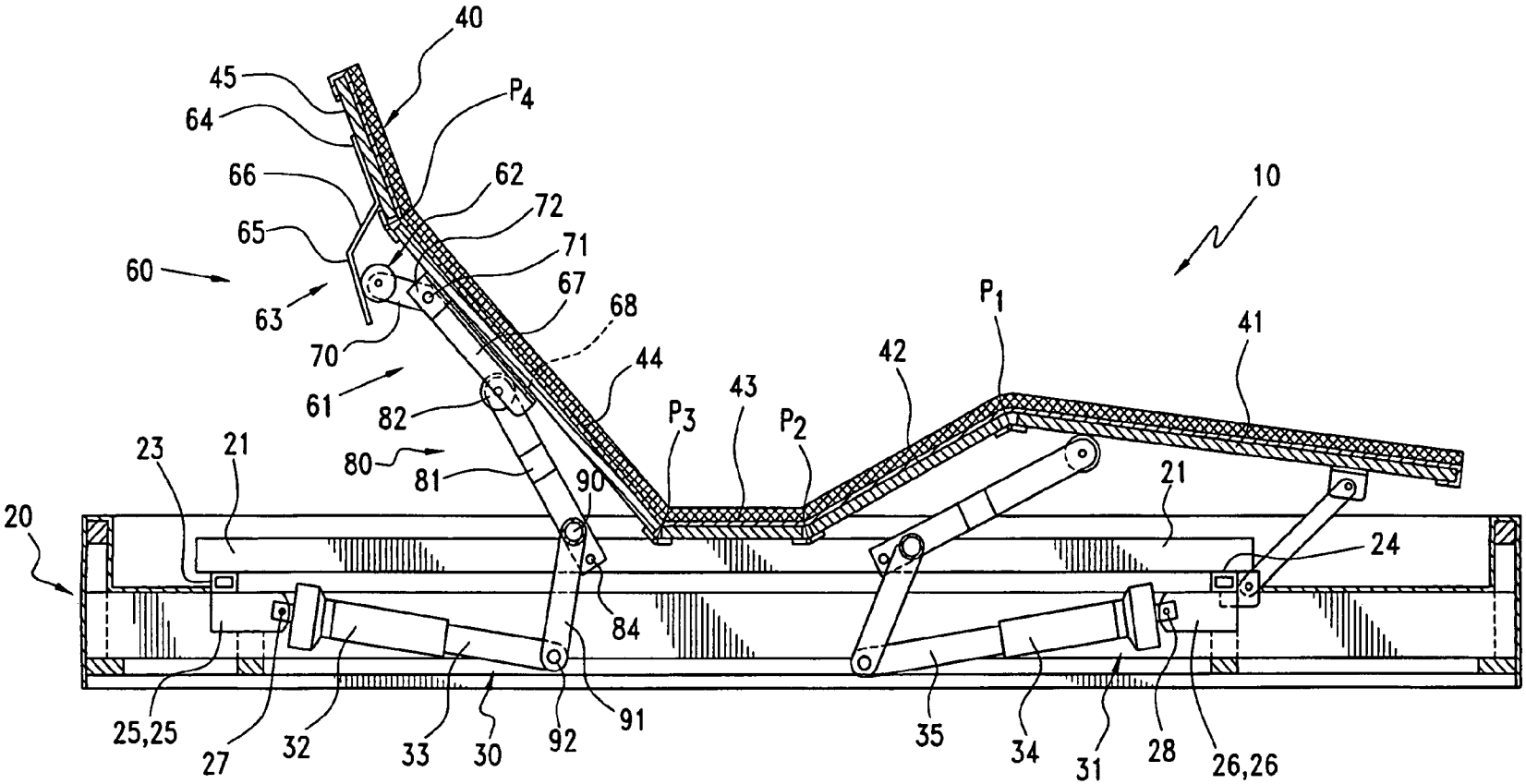
FIG. 6 is an enlarged cross-sectional view taken generally along line 6—6 of FIG. 3, and illustrates one of several other positions of relative pivoting movement of the back support at each of which the inclination of the head support to the back support remains constant and corresponds to that of FIG. 5.
Figure 7:
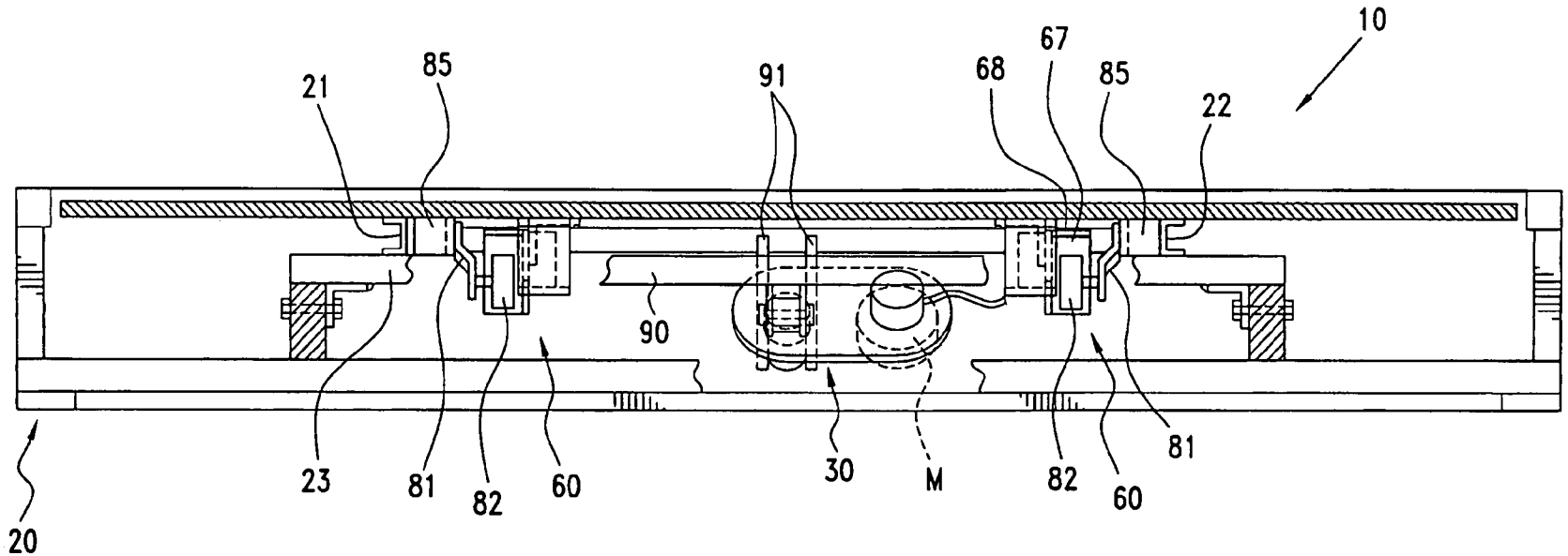
FIG. 7 is an enlarged fragmentary cross-sectional view taken generally along line 7—7 of FIG. 4 with parts broken away for clarity, and illustrates further details of the cam and cam follower mechanisms.
Figure 9:
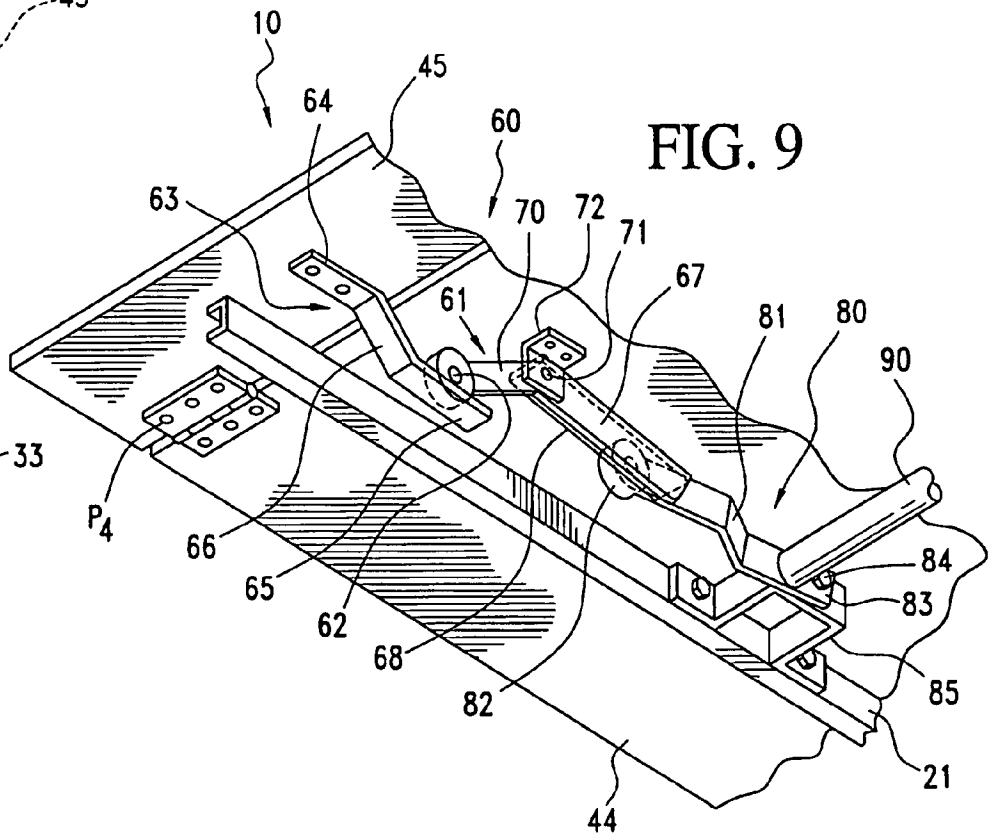
FIG. 9 is a fragmentary bottom perspective view of one side of the underside of the head and back supports, and illustrates the cam follower connected to the head support, a first linkage carrying a cam pivotally connected to the back support and a second linkage carrying another cam pivotally connected to a main support frame of the adjustable bed.
Figure 8:
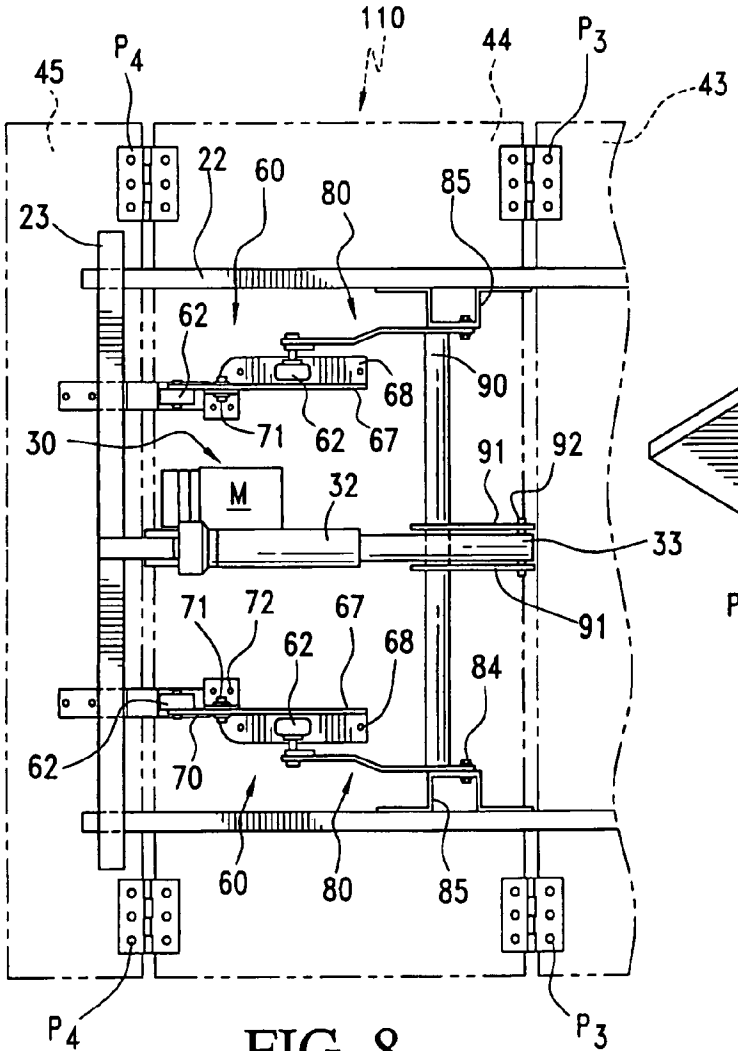
FIG. 8 is a fragmentary bottom plan view of the adjustable bed head end, and illustrates the motion transmission mechanism, the two linkages and the cam and cam followers for effecting tilting or adjusting movement of the head support relative to the back support.

A bed frame 20 of the adjustable bed 10 specifically includes opposite, parallel transversely spaced side rails 21, 22 of a generally C-shaped cross section which open away from each other (FIGS. 7 and 9). The side rails 21, 22 are seated upon and are welded to upper surfaces of tubular cross bars 23, 24 (FIGS. 4–6) located adjacent head and foot ends (unnumbered) of the adjustable bed 10. A pair of parallel spaced brackets 25, 25 and 26, 26 are welded in side-by-side relationship to the underside of the respective cross braces 23, 24, as is best illustrated in FIGS. 6 and 8 of the drawings. Pivot means 27, 28 connect the respective brackets 25, 25; 26, 26 to respective drive means 30, 31. The drive means 30, 31 are fully described in the latter-identified patent application, and each includes a reversible electric motor M (FIGS. 7 and 8) and relatively telescopic members 32, 33; 34, 35, respectively, which can be relatively extended and retracted by the operation of the respective motors M in either of two directions of rotation. Internal meshed nuts and screw threads between the members 32, 33; 34, 35 effect the relative extension and retraction in a conventional manner. The latter movement of the drive means 30, 31 achieves movement of a mattress support 40 from a substantially flat horizontal uniplanar position (FIGS. 1 and 4) to a number of different inclined positions (FIGS. 2, 3 and 6) which similarly effects movement of a mattress Mt (FIG. 1) supported thereupon. The mattress support 40 includes a leg support 41, a thigh support 42, a hip support 43, a back support 44 and a head support 45 with adjacent supports being pivotally connected by conventional pivot means or hinges P1, P2, P3 and P4 (FIGS. 4–6 and 8).

As is best illustrated in FIGS. 4 through 9 of the drawings, motion transmission means 60 are defined by duplicate constructions located one at each of the side rails 21, 22 which have been identically numbered for ease of understanding. Each of the motion transmission means or mechanism 60 includes first linkage means 61, cam means 62 and cam follower means 63 (FIG. 9). Each cam follower means 63 is in the form of a generally shallow Z-shaped bracket having opposite substantially parallel legs 64, 65 and an inclined center portion 66. Each of the legs 64 is secured by screws (unnumbered) to the head support 45 adjacent the side rails 21, 22.

The linkage means or mechanism 61 includes a first arm 67 which is substantially L-shaped in transverse cross-section and includes a horizontal flange 68 (FIG. 8). The linkage means 61 also includes a second arm 70, and at a juncture (unnumbered) of the first and second arms 67, 70, respectively, the linkage means 61 is connected by a substantially horizontal pivot 71 to a bracket 72 which is in turn fastened to the back support 44 adjacent each of the side rails 21, 22. The cam means 62 is a cam roller which is connected to the second arm 70 (FIG. 9) of the linkage mechanism 61 and rolls along the leg 65 and the central inclined portion 66 of the cam follower 63 in the manner to be described hereinafter.

The linkage means 61 is operated by a second linkage means or linkage mechanism 80 which also defines means for effecting pivoting movement of the back support 44. One such linkage mechanism 80 is located adjacent each side rail 21, 22 and is operative with respect to its associated motion transmission means 60 and first linkage mechanism 61.

Each second linkage mechanism 80 is defined by a first arm 81 which carries a cam means or cam roller 82 and offset therefrom is a second arm 83 pivotally connected by a pivot pin 84 to a bracket 85 which is in turn fixed one to each of the side rails 21, 22. A tubular connector 90 is welded to the second arms 83 of the second linkage mechanisms 80, 80 and centrally thereof are welded a pair of spaced brackets 91 (FIGS. 7 and 8) which in turn are connected by a pivot pin 92 to the end of each respective member 33 (FIGS. 6 and 8) of the drive means 30.

OPERATION

Figure 4:
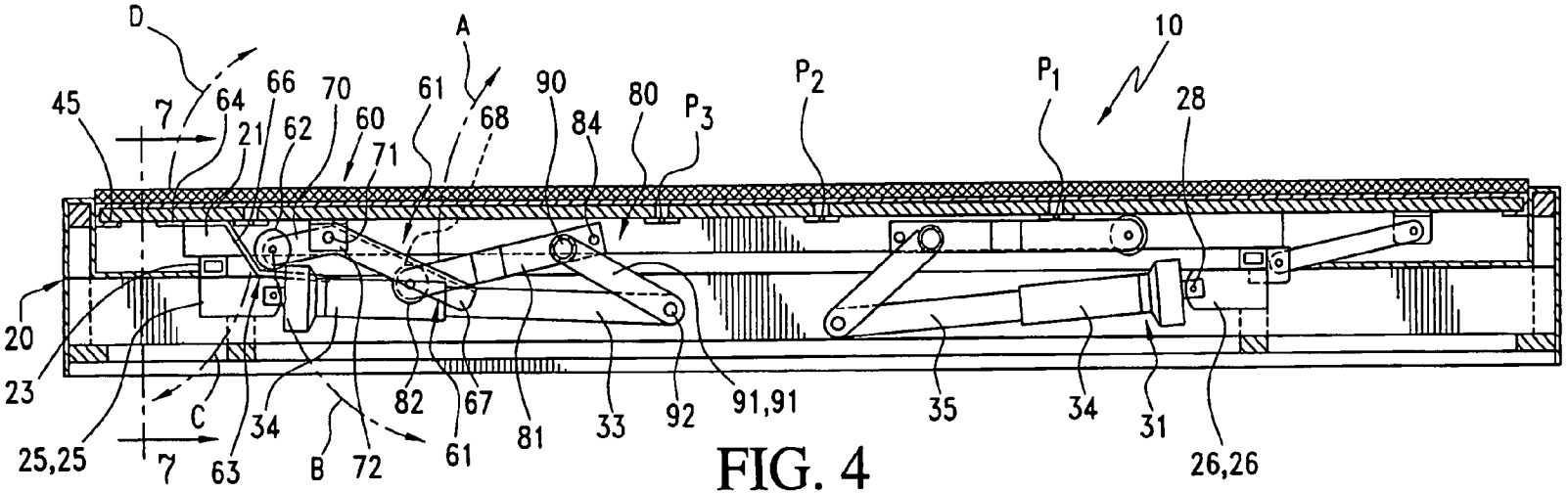
FIG. 4 is an enlarged cross-sectional view taken generally along line 4—4 of FIG. 1, and illustrates head, back, hip, thigh and leg supports in a common horizontal plane, and a motion transmission mechanism in the form of two linkages and a cam and cam follower operated thereby to effect relative pivoting and adjusting movement between the head and back supports.

The various components of the adjustable bed 10 are illustrated in FIG. 4 of the drawings in a first position at which the leg, thigh, hip, back and head supports 41–45, respectively, are disposed in a common horizontal plane. Each cam 62 is positioned substantially at the juncture of the leg 65 and the central inclined portion 66 of each of the cam follower means 63 (FIG. 4). The arm 67 of the linkage mechanism 61 is inclined downwardly and defines an acute angle with the back support 44. Each cam roller 82 rests against an underside of the flange 68 of the first arm 67 of the first linkage mechanism 61 and each second linkage mechanism 80 is inclined downwardly and to the left, as viewed in FIG. 4. The members 32, 33 of the drive means 30 are in their fully extended positions.

Figure 5:
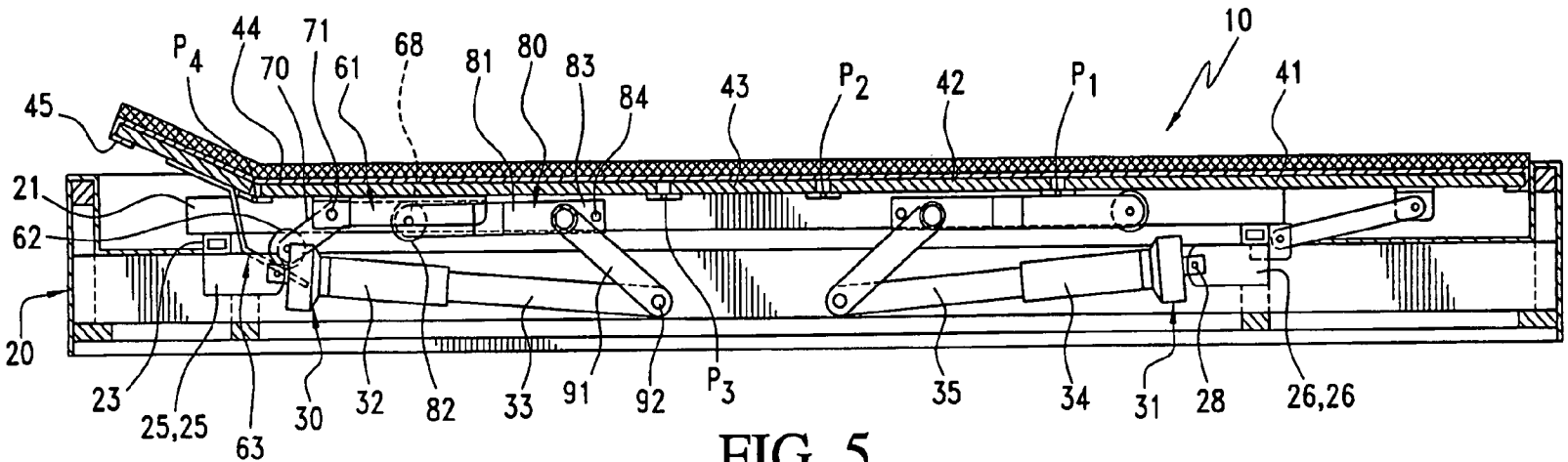
FIG. 5 is an enlarged cross-sectional view taken generally along line 5—5 of FIG. 2, and illustrates a relative position of movement of the two linkages and the cam and cam follower which effects initial tilting of the head support absent movement of the back support from its horizontal position.

When it is desired to tilt, incline or adjust the head support 45 relative to the back support 44 from the position shown in FIG. 4 to the position shown in FIG. 5, a switch (not shown) is closed to energize the motor M of the drive means 30 in a direction to progressively retract the member 33 into the member 32 which through the pivot 92, the brackets 91, and the tube connector 90 simultaneously pivot both second linkage mechanisms 80, 80 clockwise from the position shown in FIG. 4 about the pivots 84. During the clockwise pivoting movement of the second linkage mechanisms 80, 80 which is indicated by the arrow A associated therewith in FIG. 4, each of the cam rollers 82 rise and move along the associated flange 68 of the associated arm 67 of the first linkage mechanism 61 effecting pivoting thereof about the respective pivots 71 which causes the second arm 70 of each first linkage mechanism 61 to follow a downward arc, as is indicated by the arrow B in FIG. 4, which progressively moves each cam roller 62 along the leg 65 of each cam follower 63 resulting in pivoting of the cam follower 63 progressively along the arc C (FIG. 4) about the pivot means 71 and corresponding pivoting of the head support 45 about the pivot P4 resulting in the progressive upward tilting movement of the head support 45 from the position shown in FIG. 4 to the position shown in FIG. 5 along the arc D of FIG. 4.

It is to be particularly noted that during the initial pivoting movement of the second linkage means 80 from the position shown in FIG. 4, the first arm 81 thereof moves from the position shown in FIG. 4 to the position shown in FIG. 5 about the arc A absent any effect upon the back support 44. The latter lost motion connection allows selective adjustment of the head support 45 to, from and between the positions shown in FIGS. 4 and 5 absent any movement of the back support 44.

However, once each cam roller 82 reaches the position shown in FIG. 5, the horizontal flanges 68 of the first arms 67 of the first linkage mechanisms 61 contact the flat underside (unnumbered) of the back support 44, which is the position illustrated in FIG. 5. Once the latter position is reached and as the member 33 is further retracted into the member 32 of the drive means 30 beyond the position shown in FIG. 5, the continued pivoting movement of the second linkage mechanism 80 along the arc A of FIG. 5 progressively pivots the back support 44 about the pivot P3 to any one of a number of inclined positions, such as shown in FIG. 6. Since the flange 68 of each of the first arms 67 of each first linkage mechanism 61 is in contact with the underside of the back support 44 in the position shown in FIG. 5, any further pivoting movement along the arc A from the position shown in FIG. 5 results in the immediate and progressive upward pivoting movement of the back support 44 about the pivots P3. It is to be particularly noted that the relative angle of inclination between the head support 45 and the back support 44 in FIG. 6 corresponds substantially identically to that shown in FIG. 5. In other words, the relative inclination of the head support 45 relative to the back support 44 established through the pivoting of the first linkage mechanism 61 and the operation of the motion transmission means 60, including the cam rollers 62 and the cam follower 63, establish a fixed relative angle of inclination which remains the same from the position shown in FIG. 5 through any position of inclination of the back support 44 effected thereafter, again as is reflected in FIG. 6 of the drawings.

Obviously, the motor M of the drive means 30 is reversed to effect the return of the adjustable bed 10 progressively from the relative positions of the mechanisms shown in FIG. 6 to the positions thereof illustrated in FIG. 4.

Although a preferred embodiment of the invention has been specifically illustrated and described herein, it is to be understood that minor variations may be made in the apparatus without departing from the spirit and scope of the invention, as defined by the appended claims.

What is claimed is:

1. An adjustable bed section comprising a head support and a back support adapted to respectively support a person's head and back, means for pivotally connecting said head and back supports for pivoting movement relative to each other, means for pivotally moving said back support, motion transmission means disposed between said head and back supports and operable in response to the operation of said pivotally moving means; said motion transmission means including:

first linkage means for moving said head section from a substantially horizontal position to an inclined position whereby a person's head and back can be supported at substantially inclined and horizontal positions, respectively, and, second linkage means for moving said back section from a substantially horizontal position to an inclined position;

cooperative cam means and cam follower means responsive to the operation of said motion transmission means during the pivoting of the head support toward its substantially inclined position, one of said cam means and cam follower means being carried by one of said first and second linkage means, and another of said cam and cam follower means being carried by another of said first and second linkage means.

2. The adjustable bed section as defined in claim 1 wherein said second linkage means is operatively associated between said first linkage means and said pivotally moving means.

3. The adjustable bed section as defined in claim 1 wherein said first linkage means is pivotally connected to said back section.

4. The adjustable bed section as defined in claim 1 including a support frame, and said second linkage means is pivotally connected to said support frame.

5. An adjustable bed section comprising a head support and a back support adapted to respectively support a person's head and back, means for pivotally connecting said head and back supports for pivoting movement relative to each other, first and second linkage mechanisms, first and second linkage pivots for pivoting said respective first and second linkage mechanisms for movement between first positions at which said head and back supports are in a first substantially horizontal position and second positions at which said head and back supports are in a second substantially inclined position relative to a horizontal plane, means for imparting initial pivotal movement to said second linkage absent movement of said back support from its first substantially horizontal position, means for transmitting the initial pivotal movement of said second linkage mechanism to said first linkage mechanism for effecting pivoting of said head section from its first substantially horizontal position to its second substantially inclined position, and said transmitting means includes a first portion of said second linkage mechanism in rolling bearing engagement with a first portion of said first linkage mechanism.

6. An adjustable bed section comprising a head support and a back support adapted to respectively support a person's head and back, means for pivotally connecting said head and back supports for pivoting movement relative to each other, first and second linkage mechanisms, first and second linkage pivots for pivoting said respective first and second linkage mechanisms for movement between first positions at which said head and back supports are in a first substantially horizontal position and second positions at which said head and back supports are in a second substantially inclined position relative to a horizontal plane, means for imparting initial pivotal movement to said second linkage absent movement of said back support from its first substantially horizontal position, means for transmitting the initial pivotal movement of said second linkage mechanism to said first linkage mechanism for effecting pivoting of said head section from its first substantially horizontal position to its second substantially inclined position, and said transmitting means including a first portion of said second linkage mechanism in camming bearing engagement with a first portion of said first linkage mechanism.

7. An adjustable bed section comprising a head support and a back support adapted to respectively support a person's head and back, means for pivotally connecting said head and back supports for pivoting movement relative to each other, first and second linkage mechanisms, first and second linkage pivots for pivoting said respective first and second linkage mechanisms for movement between first positions at which said head and back supports are in a first substantially horizontal position and second positions at which said head and back supports are in a second substantially inclined position relative to a horizontal plane, means for imparting initial pivotal movement to said second linkage absent movement of said back support from its first substantially horizontal position, means for transmitting the initial pivotal movement of said second linkage mechanism to said first linkage mechanism for effecting pivoting of said head section from its first substantially horizontal position to its second substantially inclined position, and said first and second linkage mechanisms each having first and second arms, and said first arms of said first and second linkage mechanisms being in bearing engagement with each other.

8. The adjustable bed section as defined in claim 7 wherein one of said first arms includes a follower and another of said first arms includes a follower surface along which said follower moves.

9. An adjustable bed section comprising a head support and a back support adapted to respectively support a person's head and back, means for pivotally connecting said head and back supports for pivoting movement relative to each other, first and second linkage mechanisms, first and second linkage pivots for pivoting said respective first and second linkage mechanisms for movement between first positions at which said head and back supports are in a first substantially horizontal position and second positions at which said head and back supports are in a second substantially inclined position relative to a horizontal plane, means for imparting initial pivotal movement to said second linkage absent movement of said back support from its first substantially horizontal position, means for transmitting the initial pivotal movement of said second linkage mechanism to said first linkage mechanism for effecting pivoting of said head section from its first substantially horizontal position to its second substantially inclined position, said first and second linkage mechanisms each having first and second arms, and said first arms of said first and second linkage mechanisms being in sliding bearing engagement with each other.

10. The adjustable bed section as defined in claim 9 wherein said first and second linkage pivots are located between said first and second arms of at least one of said first and second linkage mechanisms.

11. An adjustable bed section comprising a head support and a back support adapted to respectively support a person's head and back, means for pivotally connecting said head and back supports for pivoting movement relative to each other, first and second linkage mechanisms, first and second linkage pivots for pivoting said respective first and second linkage mechanisms for movement between first positions at which said head and back supports are in a first substantially horizontal position and second positions at which said head and back supports are in a second substantially inclined position relative to a horizontal plane, means for imparting initial pivotal movement to said second linkage absent movement of said back support from its first substantially horizontal position, means for transmitting the initial pivotal movement of said second linkage mechanism to said first linkage mechanism for effecting pivoting of said head section from its first substantially horizontal position to its second substantially inclined position, said first and second linkage mechanisms each having first and second arms, and said first arms of said first and second linkage mechanisms being in rolling bearing engagement with each other.

12. An adjustable bed section comprising a head support and a back support adapted to respectively support a person's head and back, means for pivotally connecting said head and back supports for pivoting movement relative to each other, first and second linkage mechanisms, first and second linkage pivots for pivoting said respective first and second linkage mechanisms for movement between first positions at which said head and back supports are in a first substantially horizontal position and second positions at which said head and back supports are in a second substantially inclined position relative to a horizontal plane, means for imparting initial pivotal movement to said second linkage absent movement of said back support from its first substantially horizontal position, means for transmitting the initial pivotal movement of said second linkage mechanism to said first linkage mechanism for effecting pivoting of said head section from its first substantially horizontal position to its second substantially inclined position, said first and second linkage mechanisms each having first and second arms, and said first arms of said first and second linkage mechanisms being in camming bearing engagement with each other.

13. The adjustable bed section as defined in claim 12 wherein said first and second linkage pivots are located between said first and second arms of at least one of said first and second linkage mechanisms.

14. The adjustable bed section as defined in claim 12 wherein said first and second linkage pivots are located between said first and second arms of at least one of said first and second linkage mechanisms.

15. An adjustable bed section comprising a head support and a back support adapted to respectively support a person's head and back, means for pivotally connecting said head and back supports for pivoting movement relative to each other, first and second linkage mechanisms, first and second linkage pivots for pivoting said respective first and second linkage mechanisms for movement between first positions at which said head and back supports are in a first substantially horizontal position and second positions at which said head and back supports are in a second substantially inclined position relative to a horizontal plane, means for imparting initial pivotal movement to said second linkage absent movement of said back support from its first substantially horizontal position, means for transmitting the initial pivotal movement of said second linkage mechanism to said first linkage mechanism for effecting pivoting of said head section from its first substantially horizontal position to its second substantially inclined position, said first and second linkage mechanisms each having first and second arms, said first and second linkage pivots being located between said first and second arms of at least one of said first and second linkage mechanisms, and said first arms of said first and second linkage mechanisms being in bearing engagement with each other.

* * * * *